US011492196B2

(12) United States Patent
Pung

(10) Patent No.: US 11,492,196 B2
(45) Date of Patent: Nov. 8, 2022

(54) PORTABLE APPARATUS FOR EMPTYING A WASTE RECEPTACLE

(71) Applicant: Barton Malow Ventures LLC, Southfield, MI (US)

(72) Inventor: Zachary Thomas Pung, Whitmore Lake, MI (US)

(73) Assignee: Barton Malow Ventures LLC, Southfield, MI (US)

( * ) Notice: Subject to any disclaimer, the term of this patent is extended or adjusted under 35 U.S.C. 154(b) by 0 days.

(21) Appl. No.: 17/178,941

(22) Filed: Feb. 18, 2021

(65) Prior Publication Data

US 2021/0253347 A1 Aug. 19, 2021

Related U.S. Application Data

(60) Provisional application No. 62/978,371, filed on Feb. 19, 2020.

(51) Int. Cl.

| | |
|---|---|
| ***B65F 3/10*** | (2006.01) |
| ***B65F 3/06*** | (2006.01) |
| *B65F 3/02* | (2006.01) |

(52) U.S. Cl.

CPC ..... *B65F 3/10* (2013.01); *B65F 3/06* (2013.01); *B65F 2003/023* (2013.01); *B65F 2003/025* (2013.01); *B65F 2003/0296* (2013.01)

(58) Field of Classification Search

CPC ..... B65F 3/10; B65F 3/06; B65F 2003/023; B65F 2003/025; B65G 65/23

See application file for complete search history.

(56) References Cited

U.S. PATENT DOCUMENTS

| | | | | |
|---|---|---|---|---|
| 3,279,635 | A * | 10/1966 | Avery | B65G 65/23 414/420 |
| 4,597,710 | A * | 7/1986 | Kovats | B65F 3/08 187/302 |
| 5,056,979 | A | 10/1991 | Niederer et al. | |
| 5,302,073 | A * | 4/1994 | Riemersma | B65G 65/23 298/11 |
| 6,644,907 | B1 * | 11/2003 | Pinder | B65G 65/23 414/424 |

(Continued)

OTHER PUBLICATIONS

Compactors Inc., "Model HDL-2 Hydraulic Lift", 2 pages, Jul. 25, 2019.

(Continued)

*Primary Examiner* — Jonathan Snelting

(74) *Attorney, Agent, or Firm* — Brooks Kushman P.C.

(57) ABSTRACT

An apparatus is provided with an outer frame with a series of wheels, and first and second support arms connected to the outer frame and extending upwardly. The apparatus has first and second rails to slidably receive an upper lip of a portable waste receptacle, with the first rail supported by the first support arm for translation relative to the first support arm. The apparatus has a dumping system with a lifting assembly and a power assembly. The dumping system is connected to the outer frame and the first rail to move the first and second rails along the first and second support arms between a load position and a dumping position. A controller is in communication with the dumping system to control the position of the first and second rails via the dumping system.

19 Claims, 14 Drawing Sheets

(56) References Cited

U.S. PATENT DOCUMENTS

| | | | | |
|---|---|---|---|---|
| 7,018,155 | B1 * | 3/2006 | Heberling | B62B 3/0606 414/408 |
| 9,126,755 | B2 * | 9/2015 | Walter | B65F 1/1452 |
| 10,661,987 | B2 * | 5/2020 | Vasilescu | B60P 1/00 |

OTHER PUBLICATIONS

Hardy Lean Solutions, "Tipper XL (HCD-2500)", https://www.hardylifts.com/hcd-2500, circa Jan. 2020, 4 pages.
You Tube, https://www.youtube.com/watch?v=78R0u6nKyZE, Hardy Lean Solutions, Tipper In Use (Waste Management), Dec. 1, 2019, 3 pages.
You Tube, https://www.youtube.com/watch?v=7jBtVlxLZw&feature-youtu.be, Hardy Lean Solutions, "TipperXL Product Demonstration (Perfect for Construction Sites", Jan. 24, 2020, 3 pages.
https://www.vestil.com/product.php?FID=227, "Manual & Electric Hydraulic Trash Can Dumpers", Jul. 25, 2019, 6 pages.
https:www.toter.com/professional/product/mobile-cart-lifter, "Mobile Trash Cart Lifter", Jul. 24, 2019, 3 pages.

* cited by examiner

PORTABLE APPARATUS FOR EMPTYING A WASTE RECEPTACLE

CROSS-REFERENCE TO RELATED APPLICATIONS

This application claims the benefit of U.S. provisional application Ser. No. 62/978,371 filed Feb. 19, 2020, the disclosure of which is hereby incorporated in its entirety by reference herein.

TECHNICAL FIELD

Various embodiments relate to a portable apparatus for emptying a waste receptable such as a tilt truck or trash gondola into a waste container such as a roll-on container.

BACKGROUND

A waste container such as a dumpster or roll off waste container is conventionally filled with refuse or debris with a user throwing waste into the waste container 20. This is inefficient as the user needs to handle the waste piece by piece, and may not be practical depending on the type and size of waste. Alternatively, machinery such as a forklift may be used to empty a portable waste receptacles into a waste container. A waste container may be filled unevenly if the waste is dumped over the top and into the container from one location, e.g. one end of the container. Furthermore, if the waste container is on uneven ground, such as at a building or construction site, it may be difficult to maneuver around the entire perimeter of the waste container to fill it.

SUMMARY

In an embodiment, an apparatus has an outer frame with an end wall positioned between and connecting first and second side walls, and with the outer frame having a series of wheels to support the outer frame on an underlying ground surface. A first support arm and a second support arm are provided with each support arm connected to the outer frame and extending upwardly from the outer frame to a hooked region. Each hooked region extends outwardly from the associated support arm and away from the outer frame to extend over an upper edge of an adjacent waste container. A lifting assembly is positioned within the outer frame and has a subframe with a floor. The subframe supports first and second rails, with at least one of the first and second rails supported by the first and second support arms for translation relative thereto such that the lifting assembly is moveable relative to the first and second support arms between a load position and a dumping position. Each of the first and second rails has an upper flange and a lower flange sized to slidably receive an upper lip of a portable waste receptacle. A chain drive system has an upper sprocket and a lower sprocket supported by the first support arm, and a chain in meshed engagement with the upper and lower sprockets. The chain is connected to the lifting assembly such that the chain drive system is operable to move the lifting assembly relative to the first support arm. A motor has a rotary output shaft drivingly connected to the lower sprocket. A controller is in communication with the motor to control the position of the lifting assembly relative to the chain drive system.

In another embodiment, an apparatus has an outer frame with an end wall positioned between and connecting first and second side walls. The outer frame has a series of wheels to support the outer frame on an underlying ground surface.

At least one support arm is connected to the outer frame and extending upwardly from the outer frame to a hooked region, with the hooked region shaped to extend over an upper edge of a waste container. At least one rail is positioned adjacent and alongside the outer frame, with the at least one rail supported by the at least one support arm for translation relative thereto. The at least one rail has an upper flange and a lower flange sized to slidably receive an upper lip of a portable waste receptacle. A dumping system has a lifting assembly driven by a power assembly. The dumping system is connected to the outer frame and the at least one rail to move the rail along the at least one support arm between a load position and a dumping position. A controller in communication with the dumping system to control the position of the first and second rails via the dumping system.

DETAILED DESCRIPTION

As required, detailed embodiments of the present invention are disclosed herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Various embodiments according to the present disclosure provide a mobile piece of equipment that is used to empty contents of a portable waste receptacle such as a trash gondola on a construction site. The apparatus may be provided by a mobile, three-sided frame structure that uses a motor to power actuators, such as a hydraulic actuators, to lift waste receptacles over the side of a waste container, or dumpster, and empty any contents from the waste receptacle into the container. The apparatus utilizes two rails or tracks that are designed to fit and hold the upper lip of a waste receptacle and/or lifts from the bottom of the waste receptacle, and that may be used to lift the waste receptacles or gondolas. The frame structure is supported on wheels that allow it to be able to be pushed to different areas of the containers or dumpsters so that the waste will be distributed more evenly and efficiently within the container. The apparatus has two arms that fasten the apparatus to the dumpster to hold it to the dumpster while dumping, or that extend over the dumpster.

Figure 1:
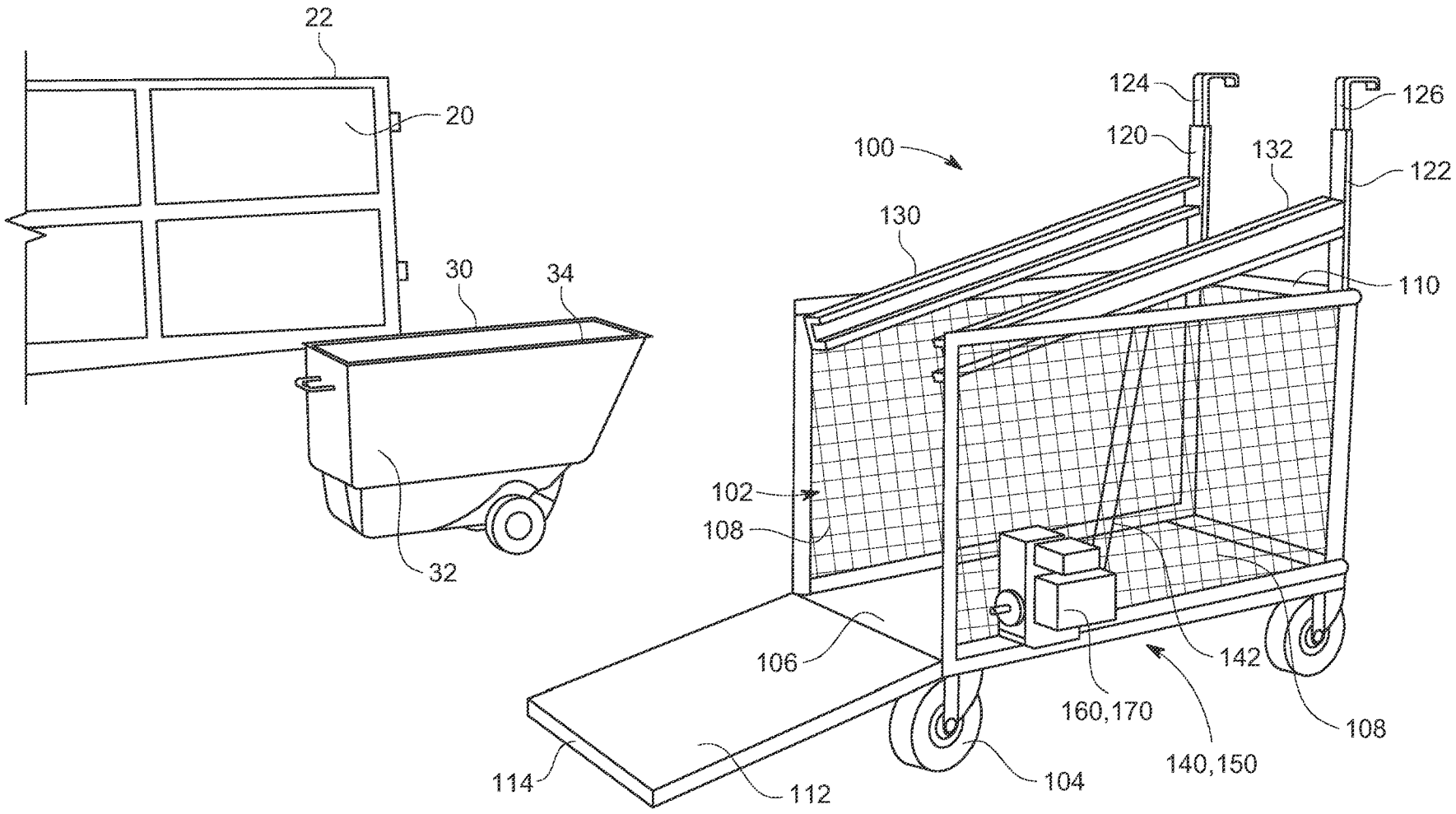
FIG. 1 illustrates a perspective view of an apparatus according to an embodiment and for use with a waste container and a portable waste receptacle.

FIG. 1 illustrates a waste container 20, a portable waste receptacle 30, and an apparatus 100 according to the present disclosure. The apparatus 100 may be used to lift and move the portable waste receptacle 30 and empty any contents within the portable waste receptacle 30 into the waste container 20.

In one example, and as described herein, the waste container 20 is a dumpster or a roll-off container. The waste container 20 may be provided as an open top dumpster and may be movable via truck or the like. The waste container 20 may be provided with a rectangular floor or outer perimeter. The container 20 has side walls that surround the floor and extend to an upper edge 22. The dumpster or container 20 may be used to contain and move waste such as construction waste, demolition waste, or other waste types. In some examples, one of the side walls, e.g. an end wall, may move to allow access to an interior region of the container 20. The container 20 may have a door on the end.

The waste container 20 may be provided in various sizes, and in one example is provided based on volume such as twenty yards or forty yards. In a further example, the container 20 has a thirty foot length, although other lengths are also contemplated for use with the disclosure.

As a container 20 is filled with refuse or construction waste, the floor begins to be covered with the refuse. The refuse on the floor provides an uneven surface that prevent limits the ability for the container 20 to be filled from the bottom up, e.g. by bringing in refuse via an open end door.

Once a container 20 is partially filled with refuse, the container 20 may continue to be filled with refuse over the upper edge 22 of a side wall, otherwise known as filling over the top. In this scenario, refuse is lifted over an upper edge 22 of one of the side or end walls of a container 20 and dropped into the interior of the container 20.

The container 20 or dumpster may be taken from the site via truck to a waste disposal facility to be emptied.

Often a smaller, portable, waste receptacle 30 is used as an intermediary to move waste from a location, such as a construction site or building, into the waste container 20. The portable waste receptacle 30 may be movable by a person. In various examples, the portable waste receptacle 30 is provided by a waste or refuse cart such as a gondola, tilt truck, trash can, or the like.

According to one example, and as shown in FIG. 1, the waste receptacle 30 is provided by a gondola or tilt truck. The gondola has a body 32 that defines a recess or cavity for receiving waste. The body 32 is supported on wheels such that the gondola is portable and easily moved by a user. The upper edge of the body is provided with a lip 34 that extends outwardly and transversely away from the body. The lip 34 may extend continuously about an entirety of the perimeter of the upper edge of the gondola according to one example, and have a generally rectangular shape for its perimeter. In another example, a lip 34 extends along two regions of the upper edge of the gondola, with the two regions being generally opposite to one another, e.g. along the two sides of the gondola. The lip 34 may be provided as a structural support frame about the gondola, and in one example, may be formed from steel or another similar material.

Previously, a user would fill a waste container 20 over the top by throwing or otherwise moving waste from a waste receptacle 30 into the waste container 20. This is inefficient as the user needs to handle the waste piece by piece, and may not be practical depending on the type and size of waste. Additionally, the container 20 may be filled unevenly if the waste is dumped over the top and into the container 20 from one location, e.g. one end of the container 20. Alternatively, machinery such as a forklift may be used to empty a waste receptacle 30 into a waste container 20.

The present disclosure provides an apparatus for filling a waste container 20 over the top with waste from a waste receptacle 30. In further examples, the apparatus may be used with waste receptacles and waste containers of various shapes and sizes. The apparatus is portable such that the waste container 20 may be filled over the top from multiple locations with waste from a waste receptacle 30, which allows for a move evenly distributed filling of the container 20, as the apparatus may be moved along the length of the container 20 as the container is filled.

FIG. 1 illustrates an apparatus 100 according to one example. The apparatus 100 is provided to move refuse such as construction waste or the like into a waste container 20 such as a dumpster described above.

The apparatus 100 has an outer frame 102. The outer frame 102 may be supported on a ground surface via a set of wheels 104. Some or all of the wheels 104 may be caster wheels to allow for controlled movement of the apparatus in various directions. One or more of the wheels 104 may be provided with a brake that is engageable to prevent rotation of the associated wheel and prevent movement of the apparatus when it is in a desired location. The wheels 104 allow for the apparatus 100 to be moved over uneven or rough terrain, such as when a waste container is positioned outdoors at a construction site. The wheels 104 also allow for the apparatus to be moved about the perimeter of the waste container as desired by a user for filling the container, for example, as soon as the apparatus 100 is delivered at a job site. The wheels 104 may be formed from different materials, including rubber, plastic, metal, and the like.

The frame 102 has a floor member 106. The floor member 106 is supported by the wheels 104 above the ground surface. The frame 102 has a pair of side walls 108 and a first end wall 110. The side walls and the first end wall surround a portion of the perimeter of the floor 106. The first end wall is positioned between the pair of side walls. The side walls and the first end wall are formed from structural members such as bars or beams, and may be covered by a metal grate or other barrier surface to prevent ingress into an interior region of the frame. The side walls and the first end wall may be fixed or immovable relative to the floor.

The frame 102 also has a second end wall 112 that is positioned to be opposite to the first end wall 110 and between the pair of side walls 108. The second end wall may be moveable relative to the floor 106 such that the second end wall moves between a deployed position and a storage position. The deployed position is shown in FIG. 1. In the deployed position, the second end wall extends from the floor to the ground surface and acts as a ramp for the receptacle 30 to allow the receptacle to be loaded into or unloaded from the apparatus 100. In the storage position, the distal end 114 of the second end wall 112 is spaced apart from the ground surface to allow the apparatus to be moved by a user. A locking mechanism, such as a lock pin, bar lock, cable connection, or the like may be provided to retain the second end wall in the storage position.

In one example, the second end wall 112 is connected to the floor 106 via a hinge such that the second end wall rotates about a transverse axis of the frame between the deployed position and the storage position. In the storage position, the second end wall 112 is positioned such that the distal end 114 is adjacent to an upper region of the side walls 108. In one non-limiting example, the second end wall is generally upright or perpendicular to the floor in the storage position. A damper may be provided to control the rate of movement of the ramp from the storage position to the deployed position.

In another example, the second end wall 112 may translate and rotate relative to the floor 106 via longitudinal tracks on a lower region of the side walls 108, or the like.

The frame 102 has a first and a second support member 120, 122, or a first and second support arm 120, 122, that extend upwardly from the floor 106 adjacent to the first end wall. In one example, the first and second support members 120, 122 may be integrally formed with the first end wall and/or the pair of side walls. Each of the first and second support members have a hooked region 124, 126. The hooked region may be provided at a distal end region of the first and second support members, and may be movable relative to the first and second support members. In one example, each hooked region slides or translates relative to the associate support member. Each of the hooked regions is shaped and sized to receive an upper edge 22 of a waste container 20. The hooked regions act to locate the apparatus 100 relative to the waste container 20, and position the receptacle 30 over the interior of the container 20 when the apparatus 100 is in the dump position. When the hooked regions are engaged with an upper edge of the waste container 20, the hooked regions act to prevent movement of the apparatus along its longitudinal axis and away from the waste container 20. The hooked regions may be provided with a rubberized or other similar friction surface to aid in retaining the apparatus relative to the waste container 20.

The apparatus 100 has a first rail 130 and a second rail 132. Each rail 130, 132 extends longitudinally along the frame 102. The first rail 130 is positioned adjacent to one of the side walls 108 of the frame, and the second rail 132 is positioned adjacent to the other side wall 108 of the frame. The first and second rails are spaced apart from one another. In one example, each of the first and second rails is provided by a linear rail section. In a further example, the first and second rails extend parallel to one another.

A first end region of the first rail 130 is connected for rotation to the first support member 120. A first end region of second rail 132 is connected for rotation to the second support member 122. The first end regions of the first and second rails may be pivotally connected to the first and second support members, respectively.

The first and second rails 130, 132 move between a load position and a dump position. The load position is shown in FIG. 1. When the first and second rails 130, 132 are in the dump position, the first and second rails extend substantially perpendicular to the floor 106 of the apparatus, or extend substantially vertically. Substantially as used herein refers to an angle within ten degrees, within fifteen degrees, or within twenty degrees of the stated angle or orientation.

Each of the rails 130, 132 may be formed with a first flange and a second flange that extend longitudinally along the rail and are spaced apart from one another. For example, each rail may be provided as a C-shaped channel. Each rail is sized and positioned to receive a portion of the lip of the waste receptacle 30 or gondola. The first and second flanges prevent movement of the waste receptacle 30 along a direction that is transverse to the flanges. As such, the first and second flanges act as guides such that the waste receptacle 30 slides or translates along a longitudinal axis of the first and second rails.

Each of the first and second rails 130, 132 are also provided with an end flange adjacent to the first end region and the support member 120, 122. The end flange acts as a limit stop for the waste receptacle 30 as the rails are moved between the load position and the dump position.

One or both of the rails 130, 132 may also be provided with a lock mechanism such as a pin or bar that extends across the open ends of the second end regions of the associated rails to prevent the waste receptacle 30 from moving or translating away from the container 20 once the waste receptacle 30 is positioned within the rails.

The apparatus has a dumping system 140. The dumping system 140 acts to move the first and second rails 130, 132 between the load position and the dump position.

Figure 2:
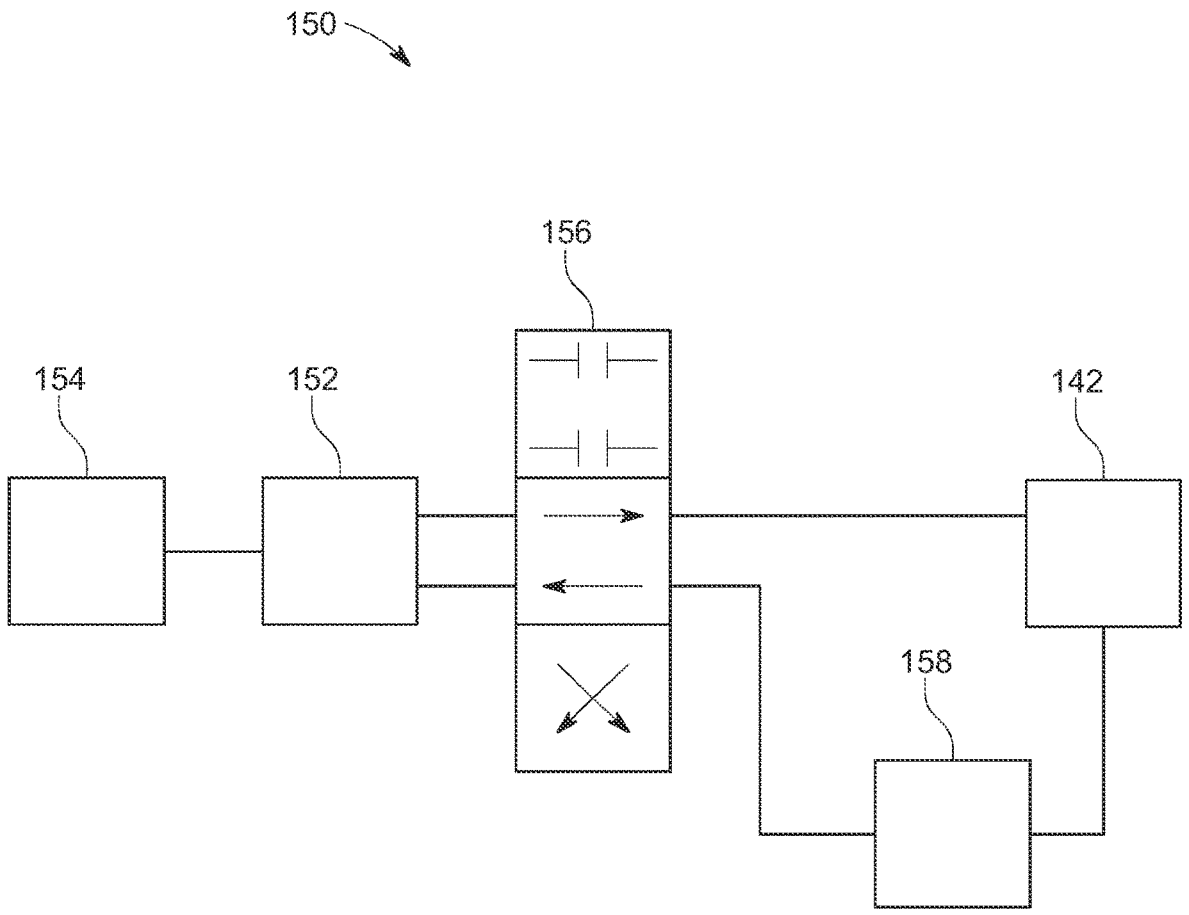
FIG. 2 illustrates a schematic of a hydraulic system for use with the dumping system and apparatus of FIG. 1.

In the example shown, the dumping system 140 is provided by one or more actuators 142 such as struts. The actuators 142 or struts may be provided within a hydraulic system 150 with a pump 152 as shown in the schematic in FIG. 2. The actuators 142 may be provided as single acting linear actuators or double acting linear actuators. The pump 152 may be driven by a prime mover 154, such as by an electric machine connected to a power supply such as a rechargeable battery or a generator, or by an internal combustion engine. The hydraulic system 150 may have any number of valves 156 including control valves or relief valves, filters 158, reservoirs, pressure indicators, fluid level indicators, and the like.

The apparatus 100 as shown has a hydraulic strut 142 that is associated with each of the rails 130, 132. One end of each hydraulic strut 142 is connected to the frame 102, e.g. adjacent to the floor 106 of the apparatus. The other end of each hydraulic strut 142 is connected to an associated one of the first and second rails 130, 132 at a location spaced apart from the first end region of the rail. In one example, and as shown, each hydraulic strut is connected to an intermediate region of the associated rail, for example, near a midpoint of the rail. In a further example, each hydraulic strut may be connected to the second end region of the associated rail.

As the hydraulic struts 142 are actuated and extend in length, the rails 130, 132 are rotated and raised with respect to the support frame 102 from the load position towards the dump position to lift the waste receptacle 30 and empty it into the waste container 20. As the hydraulic struts 142 are actuated and retract in length, the rails 130, 132 are rotated and lowered with respect to the support frame 102 from the dump position towards the load position to lower an empty waste receptacle 30.

A controller 160 is provided and is in communication with the dumping system. The controller 160 is configured to control the movement and position of the actuators 142 of the dumping system 140. In various examples, the controller 160 is coupled directly to the dumping system, connected to the dumping system via an electrical whip or cable such that the dumping system may be controlled from a distance, and/or connected wirelessly to the dumping system for remote operation.

The controller 160 may include any number of controllers, and may be integrated into a single controller, or have various modules. Some or all of the controllers may be connected by a controller area network (CAN) or other system. One or more of the controllers may be in wireless communication with another controller or with a component of the apparatus. It is recognized that any controller, circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices as disclosed herein may be configured to execute a computer-program that is embodied in a non-transitory computer readable medium that is programmed to perform any number of the functions as disclosed herein.

A user interface 170 may additionally be provided for the apparatus 100. The user interface 170 is in communication with the controller 160. The user interface may be provided by a single component, or by multiple components collectively. In one example, all or part of the user interface is connected to and supported by the apparatus. In another example, all or part of the user interface is a separate device that is in wireless communication with the controller of the apparatus, e.g. as a handheld device. In an even further example, all or part of the user interface may be provided as an application on a personal mobile device of a user, e.g. on a tablet or cellular phone.

The user interface 170 provides a control panel for the apparatus 100. In one examples, the user interface includes inputs to turn the apparatus on and off, to control the movement of the dumping system, and the like. The user interface may be provided by a light system, a display, and/or an audible alert system that is in communication with the controller. The user interface may be configured to provide alerts to the user regarding system status, and the like.

In one example, the user interface and controller cooperate to provide an input to the dumping system such that a single user input, e.g. button push, causes the dumping system to raise and dump the waste receptacle, and then lower the dumping system such that the emptied waste receptacle can be removed. The apparatus 100 may be provided with limit switches in communication with the controller to provide input to the controller as to when to stop movement of the dumping system, or reverse movement of the dumping system.

In a further example, the lock mechanism for the rails 130, 132 may be provided with a switch that indicates when the lock mechanism is engaged. The controller 160 may receive a signal from the switch that is indicative of the engagement of the lock mechanism. The controller 160 may prevent the dumping system from moving the rails from the storage position when the lock mechanism is not engaged.

The hydraulic system 150 may be provided with load sensing control, and the controller 160 may inhibit use of the hydraulic system and provide an alert to the user via the user interface if the load on the hydraulic system is higher than a threshold value, e.g. to indicate that a waste receptacle 30 is heavier than a predetermined weight for use with the apparatus.

In operation, a user moves the apparatus 100 to the desired location relative to the container 20. The user may then engage any wheel brakes, position the hooked regions 124, 126 over the upper edge 22 of the container 20, and move the second end wall 112 from the storage position to the deployed position.

The user then rolls the waste receptacle 30 up the second end wall 112, which is acting as a ramp. The lip 34 of the waste receptacle 30 is received by the first and second rails 130, 132 as the waste receptacle 30 is moved towards the container 20. Once the waste receptacle 30 is positioned within the frame 102, a lock mechanism for the rails 130, 132 may be engaged to retain the waste receptacle 30 within the rails.

The dumping system 140 is then actuated to lift the rails 130, 132 to the dump position, and empty any contents of the waste receptacle 30 into the waste container 20. The steps are reversed to lower and remove the waste receptacle 30 from the apparatus.

Figure 3:
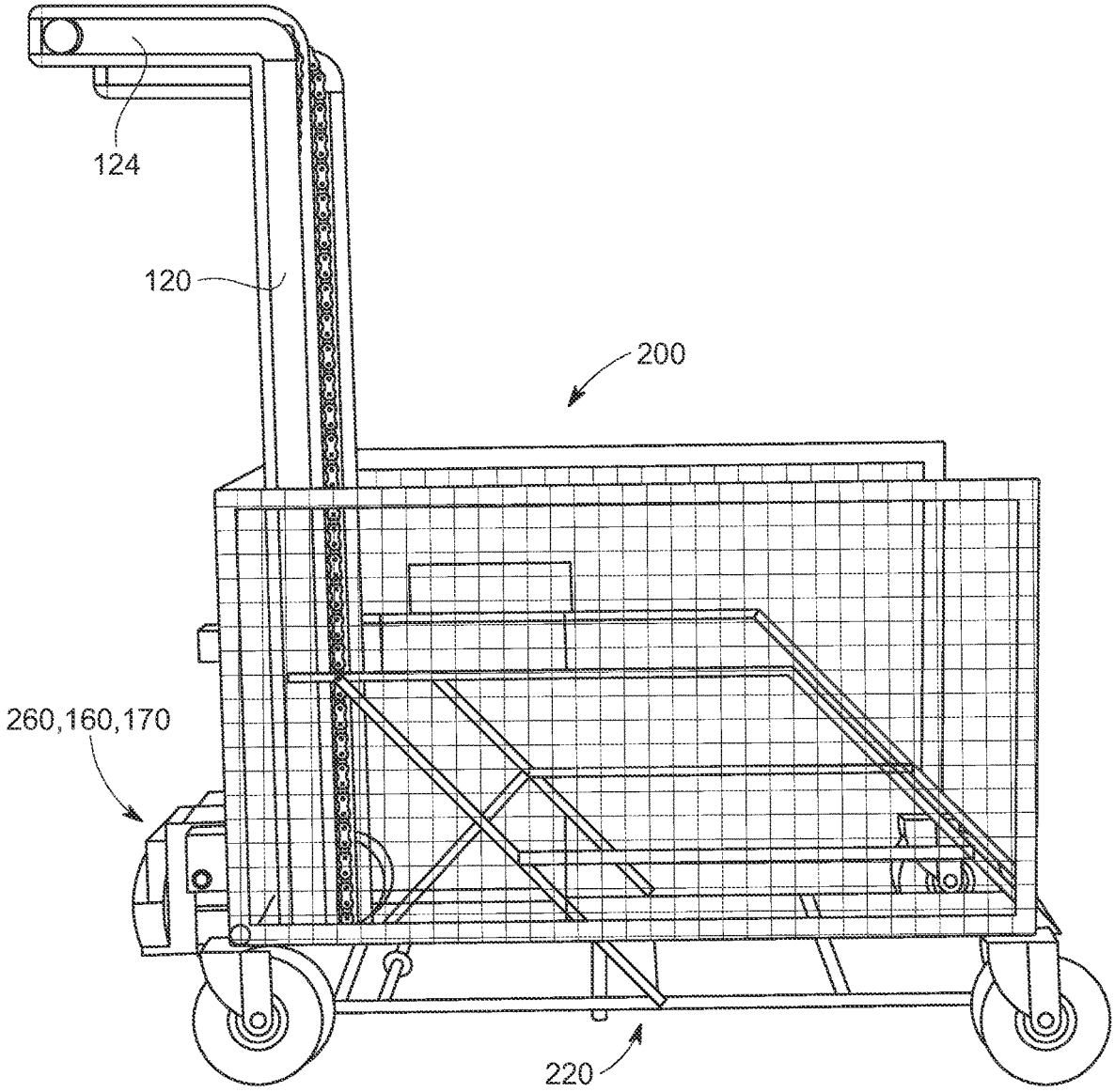
FIG. 3 illustrates a side perspective view of an apparatus according to another embodiment and for use with a waste container and a portable waste receptacle.
Figure 4:
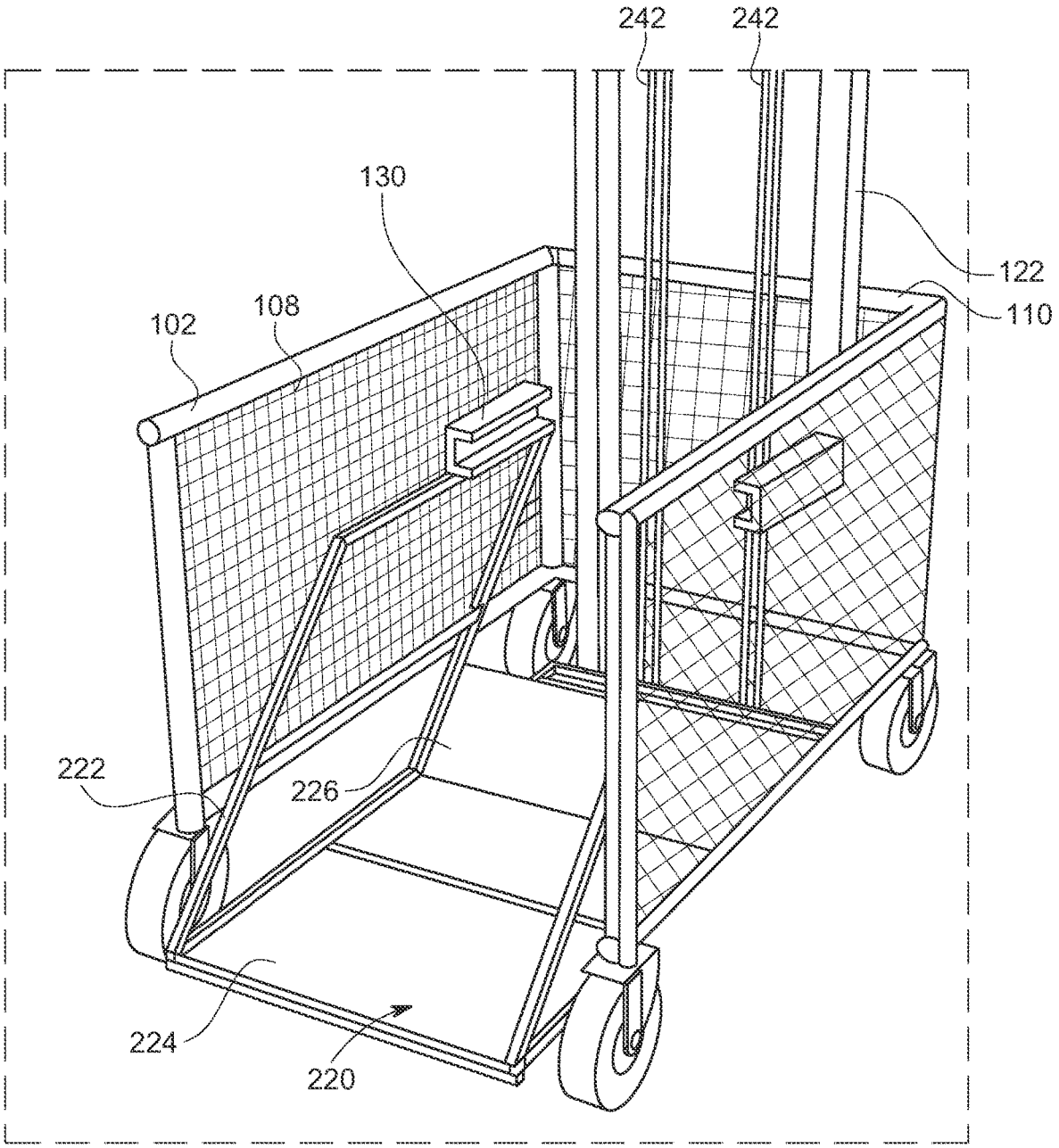
FIG. 4 illustrates a perspective view of the apparatus of FIG. 3.
Figure 5:
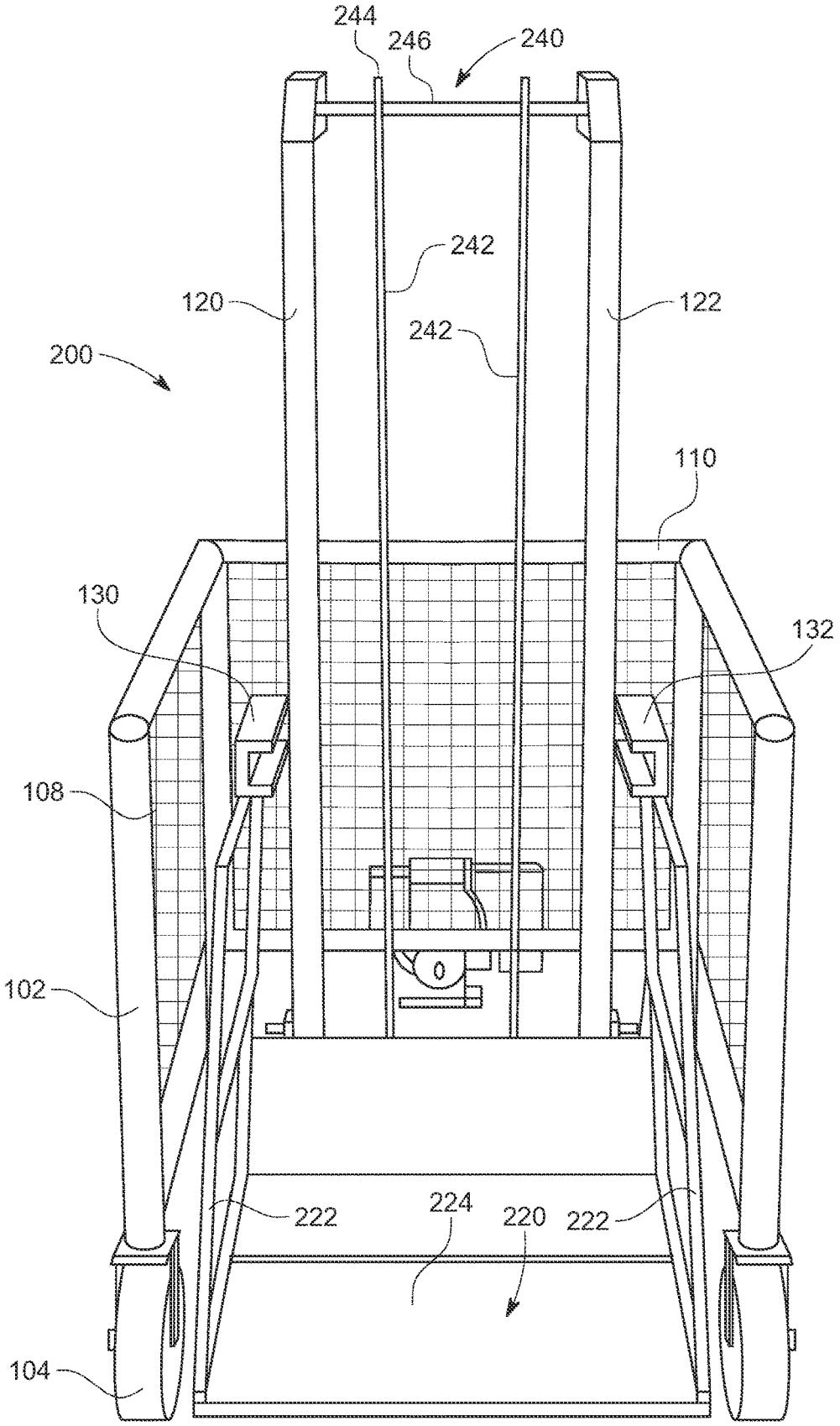
FIG. 5 illustrates a rear perspective view of the apparatus of FIG. 3.

FIGS. 3-5 illustrates an apparatus 200 according to another example and for use in moving refuse such as construction waste or the like into a waste container 20 such as a dumpster described above. Only elements that differ from those discussed above with respect to FIG. 1 are described in detail for apparatus 200. Elements that are the same as or similar to those in FIG. 1 are given the same reference number for simplicity.

The apparatus 200 has an outer frame 102 supported on a ground surface via a set of wheels 104. The frame has a pair of side walls 108 and a first end wall 110. The frame 102 is provided without a floor member extending between the side walls and first end wall. The frame 102 is also provided without a second end wall.

A first and a second support member 120, 122 are connected to the frame 102. The first and second support members 120, 122 extend upwardly adjacent to the first end wall, and are spaced apart from an underlying ground surface. Each of the first and second support members have a hooked region 124, 146 or transverse region. The hooked region may be provided at a distal end region of the first and second support members. Each of the hooked regions is shaped and sized to extend over an upper edge 22 of a waste container 20.

The apparatus 200 has a waste receptable lift assembly 220, or platform 220. The lift assembly 220 has a subframe 222 connected to a floor 224. The subframe 222 also supports a first rail 130 and a second rail 132 that extend longitudinally along at least a portion of the subframe of the lift assembly. In one example, each of the first and second rails 130, 132 is provided by a linear rail section. In a further example, the first and second rails extend parallel to one another. The subframe, floor, and first and second rails are connected together such that the do not move relative to one another.

The subframe 222 is connected to the first and second support members 120, 122 for movement relative to and along the first and second support members. In one example, the subframe 222 has guides, such as rollers or the like, that are received within tracks formed in each of the support arms. Each guide of the subframe moves within and along the associated track of the support member. The guides may be connected to the subframe adjacent to an upper edge region of the subframe.

The lift assembly 220 is movable between a load position and a dump position. The load position is shown in FIGS. 3-5. When the lift assembly is in the dump position, the first and second rails extend substantially perpendicular to the underlying ground surface, or extend substantially vertically.

Each of the rails 130, 132 may be formed with a first flange and a second flange that extend longitudinally along the rail and are spaced apart from one another to receive a portion of the lip 34 of the waste receptacle 30 or gondola, and act as guides for the waste receptacle 30. For example, each rail may be provided as a C-shaped channel. The floor 224 may have an angled surface to prevent movement of the waste receptacle 30 towards the container 20. Alternatively, the rails 130, 132 may be provided with an end flange to limit receptacle 30 movement.

The lift assembly 220 may also be provided with a lock mechanism such as a pin or bar that extends across the subframe, the floor, or the open ends of the associated rails to prevent the waste receptacle 30 from moving or translating away from the container 20 once the waste receptacle 30 is positioned within the rails.

The apparatus 200 has a dumping system 140. The dumping system 140 acts to move the first and second rails 130, 132 between the load position and the dump position. In the example shown, the dumping system 140 includes a drive system 240 and a power system 260 that cooperate to move the lift assembly 220 relative to the first and second support members 120. 122 and the frame 102, and move the lift assembly 220 between a load position and a dump position.

According to one example, the drive system 240 has at least one continuous chain that is driven by sprockets and moved via the power system 260. In another example, the chain may be replaced with a toothed belt, or the like.

Figure 6:
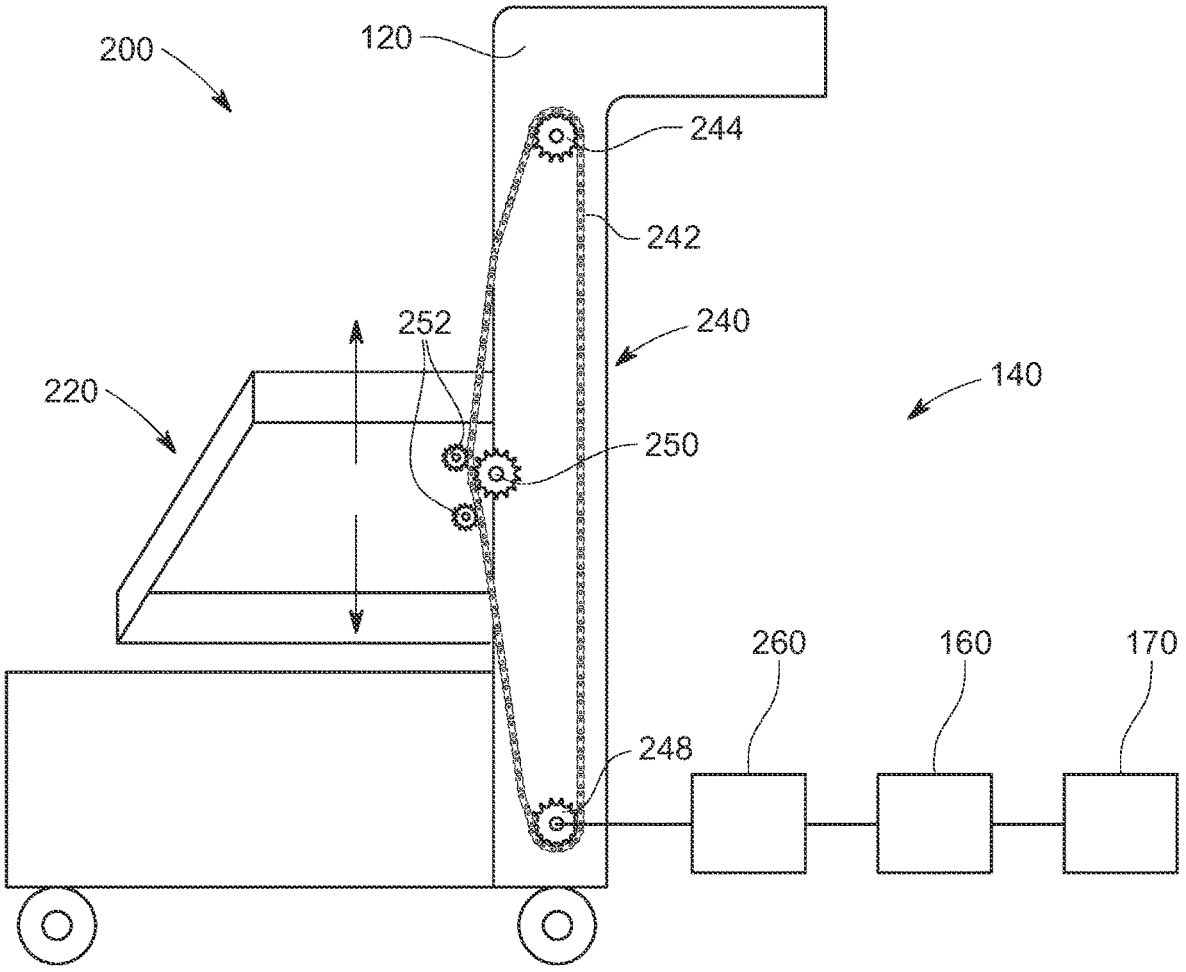
FIG. 6 illustrates a schematic view of a drive system for use with the apparatus of FIG. 3.

In the example shown in FIGS. 3-5 and in a schematic view on FIG. 6, the drive system 240 has a first continuous chain 242 and a second continuous chain 242. Each chain 242 is supported and in engagement with an associated upper sprocket 244. The upper sprocket 244 is connected to a crossbar 246 extending between the first and second support members 120, 122. The upper sprocket 244 rotates relative to the first and second support members 120. 122. In one example, the upper sprocket may be connected to the crossbar via a bearing assembly, or the like, such that the upper sprocket rotates or freewheels about the crossbar. In another example, the upper sprocket may be fixed relative to the crossbar, and the cross bar may be rotatably connected to the support members via bearing assemblies.

Each chain 242 is supported and in engagement with an associated lower sprocket. 248 The lower sprocket 248 may be the drive sprocket, and is driven by a rotary output shaft of the power system 260 as described below. A gearset providing gear reduction may be positioned between the power system output shaft and the drive sprocket. The drive sprocket 248 is supported by the outer frame 102 and rotates relative to the outer frame 102 as it is driven by the power system 260, which is also supported by the outer frame.

In one example, each chain 242 is also in engagement with a lift sprocket 250 that is connected to the lift assembly 220. The lift sprocket 250 may be fixed relative to the lift assembly 220 such that it does not rotate relative to the lift assembly. In one example, the lift sprocket 250 is connected to a crossbar extending across the subframe 222 of the lift assembly and adjacent to the floor. The chain 242 may extend between the lift sprocket 250 and a pair of tensioners 252, and the lift sprocket 250 may be offset from a line extending between the upper and lower sprockets 244, 248. The tensioners 252 cause the chain to firmly engage the lift sprocket.

Alternatively, the chain drive system 240 may be provided without a lift sprocket or tensioners 252. In this example, each chain has two ends, with each end directly connected to the lift assembly 220 to form a continuous loop.

In other examples, other chain drive systems 240 are also envisioned for use with the apparatus 300. For example, a hoist system may be used to raise and lower the lift assembly. In another example, another chain drive system may be used, with a drive sprocket and power system supported by the lift assembly, and the drive sprocket engaging a fixed chain that does not move relative to the support members. The drive system 240 may alternatively be provided by another mechanical system such as a jackscrew or the like.

In one example, the power system 260 is a hydraulic system 150 that moves and controls the drive system 240. The hydraulic system 150 may be provided with a pump as shown in the schematic in FIG. 2. The actuators 142 may be provided as rotary hydraulic actuators. Each rotary actuator 142 is connected to and drives a drive sprocket 248 that controls the movement and position of the belt or chain 242. The pump or the rotary actuators may be configured for flow in either direction, e.g. to allow the output shaft of the rotary actuator to rotate in a first direction to raise the lift assembly, and rotate in a second direction to lower the lift assembly.

The pump 152 may be driven by a prime mover 154, such as by an electric machine connected to a power supply such as a rechargeable battery or a generator, or by an internal combustion engine. The hydraulic system 150 may have any number of valves including control valves or relief valves, filters, reservoirs, pressure indicators, fluid level indicators, and the like.

In another example, the power system 260 is provided with a prime mover, such as an electric machine connected to an on-board power supply such as a rechargeable battery or a generator, or an internal combustion engine. A fuel source may be provided, such as propane, gasoline, or diesel, for a generator or internal combustion engine. In other examples, the electric machine may be connected to an external power supply, including a stand-alone generator or the electric power grid. The prime mover may be connected to the drive sprocket 248 to rotate the drive sprocket and control the movement and position of the belt or chain 242. Additional reduction gearing may be provided between the prime mover and the drive gear or drive pulley to provide a predetermined speed ratio. If the prime mover is an electric machine, it may be controlled to rotate in a first direction to raise the lift assembly, and rotate in a second direction to lower the lift assembly. If the prime mover is an engine, additional gearing and clutches may be provided to rotate the drive sprocket in a first direction to raise the lift assembly, and rotate the drive sprocket in a second direction to lower the lift assembly.

As the lower, drive sprocket 248 is rotated by the power system 260, the chain 242 is moved. The chain 242 is guided using the upper sprocket 244. The chain 242 engages the lift sprocket 250 to move, e.g. raise or lower, the lift assembly 220 relative to the support members 120, 122 and the frame 102.

As the lift assembly 220 is raised, the guides on the lift assembly travel linearly up the support members 120, 122. When the guides reach the hooked regions 124, 126, the guides follow and travel along the hooked regions. This causes the upper region of the subframe 222 to move laterally relative to the floor of the subframe, and causes a rotation or tilt of the lift assembly 220 and the waste receptable 30 to empty any contents into the waste container 20.

A controller 160 is provided and is in communication with the dumping system 140. The controller 160 is configured to control the movement and position of the drive system 240 of the dumping system 140 using the power system 260. A user interface 170 may additionally be provided. The controller 160 may be in communication with a lock mechanism on the rails, and may be used to control or inhibit use of a hydraulic system with load sensing control.

The dumping system 140 may be provided with one or more limit or proximity sensors to sense a location of the lift assembly 220 relative to the support members 120, 122, and control the operation of the power system 260 accordingly.

Figure 7:
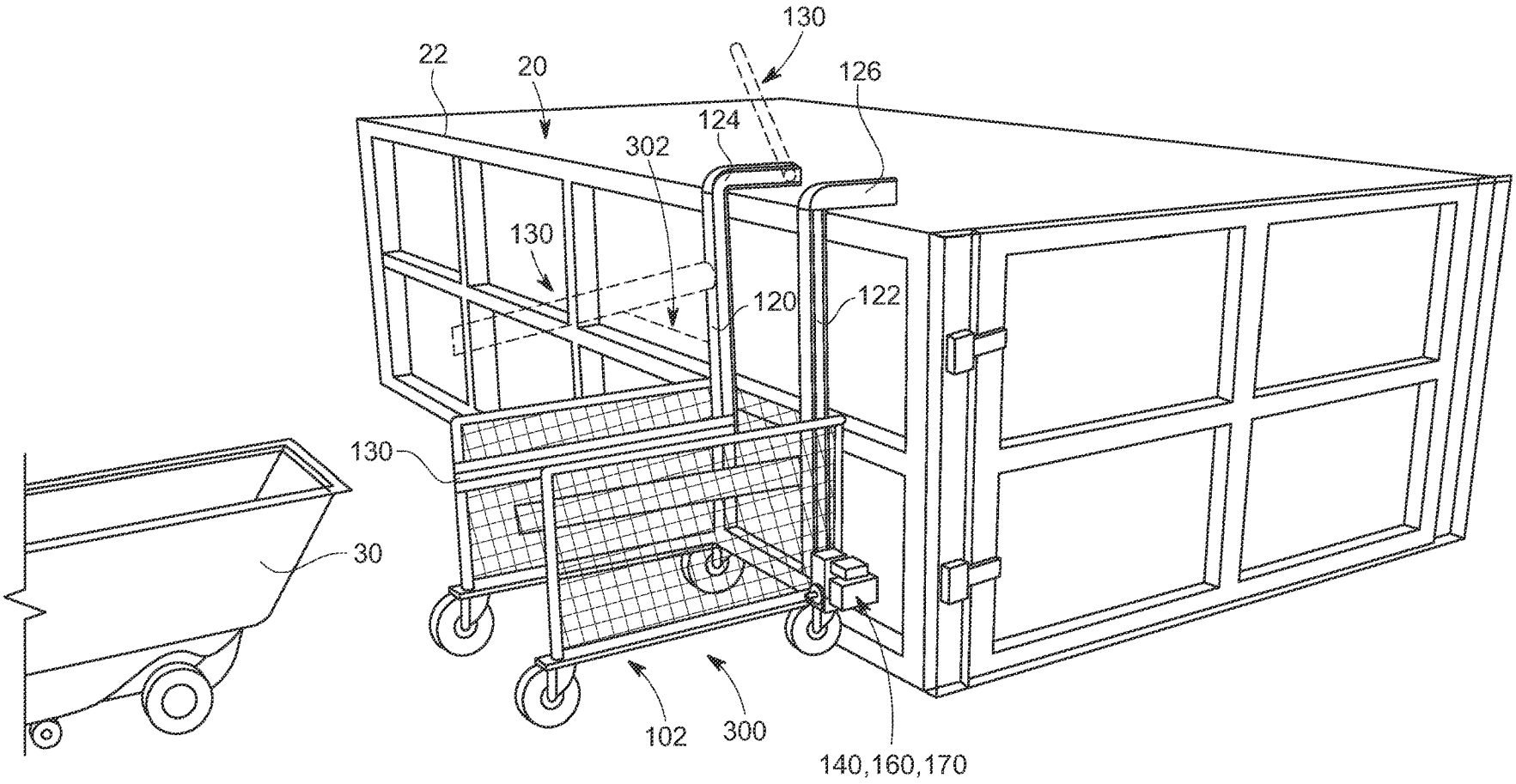
FIG. 7 illustrates a perspective view of an apparatus according to an embodiment and for use with a waste container and a portable waste receptacle.

FIG. 7 illustrates an apparatus 300 according to yet another example and for use in moving refuse such as construction waste or the like into a waste container 20 such as a dumpster described above. Only elements that differ from those discussed above with respect to FIGS. 1-6 are described in detail for apparatus 300. Elements that are the same as or similar to those in FIGS. 1-6 are given the same reference number for simplicity.

The apparatus 300 has an outer frame 102 supported on a ground surface via a set of wheels 104. The frame has a pair of side walls 108 and a first end wall 110. The frame is provided without a floor member extending between the side walls and first end wall. The frame is also provided without a second end wall.

A first and a second support member 120, 122 are connected to the frame 102. The first and second support members 120, 122 extend upwardly adjacent to the first end wall, and are spaced apart from an underlying ground surface. Each of the first and second support members have a hooked region 124, 126 or transverse region to extend over an upper edge 22 of a waste container 20.

The apparatus has a first lift arm 130 and a second lift arm 132. Each lift arm extends longitudinally alongside the first and second side walls 108 of the frame. In one example, each lift arm 130, 132 is provided by a linear rail section, and extend parallel to one another.

Each lift arm 130, 132 is connected to a respective one of the first and second support members 120, 122 for movement relative to and along the first and second support members. In one example, each lift arm 130, 132 has an associated guide that is received within a track formed in each of the support arms. The guides of the lift arms move within and along the associated track of the support member.

Each lift arm 130, 132 may be provided with an angled support member 302 extending from an intermediate region of the lift arm 130, 132 to the support member 120, 122 beneath the lift arm. The angled support member 302 provides additional support and load bearing capability to the lift arm such that the lift arm does not act as a cantilever beam. Each angled support member 302 may be provided with an associated guide that also is received with the support arm track to move within and along the track as the lift arm moves. In other embodiments, the apparatus 300 may be provided without angled support members 302, or the angled support members may be otherwise arranged.

The lift arms 130, 132 may or may not be directly connected to one another. The lift arms 130, 132 move in unison between a load position and a dump position. The load position is shown in FIG. 7 in solid lines, and an intermediate position and dump position are shown in broken lines for one arm 130 only. When the lift arms are in the dump position, the first and second rails 130, 132 extend substantially perpendicular to the underlying ground surface, or extend substantially vertically.

Each of the lift arms 130, 132 is formed with a first flange and a second flange to receive a portion of the lip of the waste receptacle 30 or gondola, and act as guides for the waste receptacle 30. The lift arms 130, 132 may be provided with an end flange to limit receptacle 30 movement.

Each lift arm 130, 132 may also be provided with a lock mechanism such as a pin or bar that extends across the subframe, the floor, or the open ends of the associated rails to prevent the waste receptacle 30 from moving or translating away from the container 20 once the waste receptacle 30 is positioned within the rails.

The apparatus 300 has a dumping system 140. The dumping system 140 acts to move the first and second lift arms 130, 132 between the load position and the dump position. In the example shown, the dumping system 140 includes a drive system 240 and a power system 260 that cooperate to move the lift arms 130, 132 relative to the first and second support members 120, 122 and the frame, and between a load position and a dump position. The dumping system 140 may be provided, along with a controller 160 and a user interface 170, as described above with respect to FIGS. 1-6.

Figure 8:
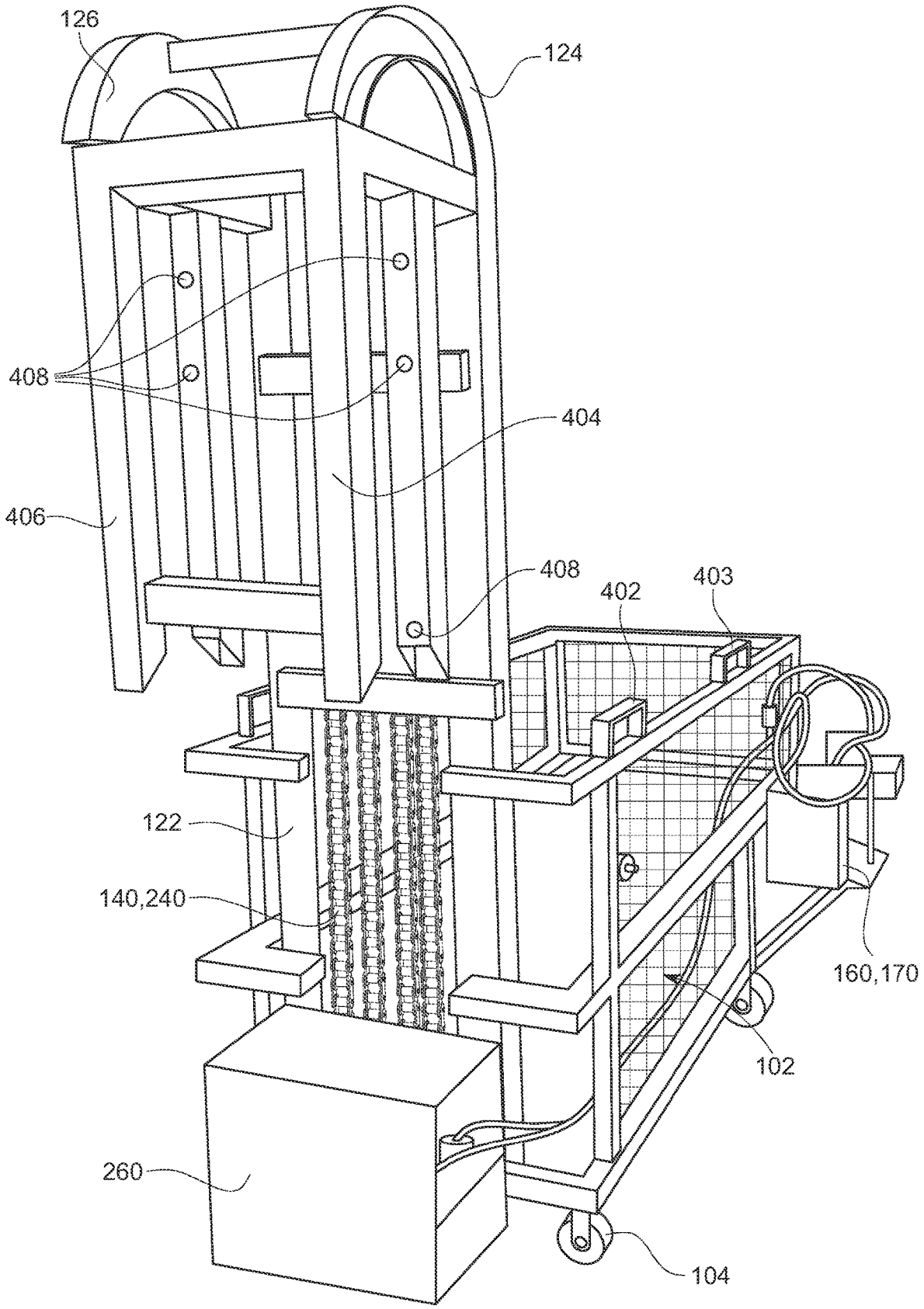
FIG. 8 illustrates a front perspective view of an apparatus according to an embodiment and for use with a waste container and a portable waste receptacle.
Figure 9:
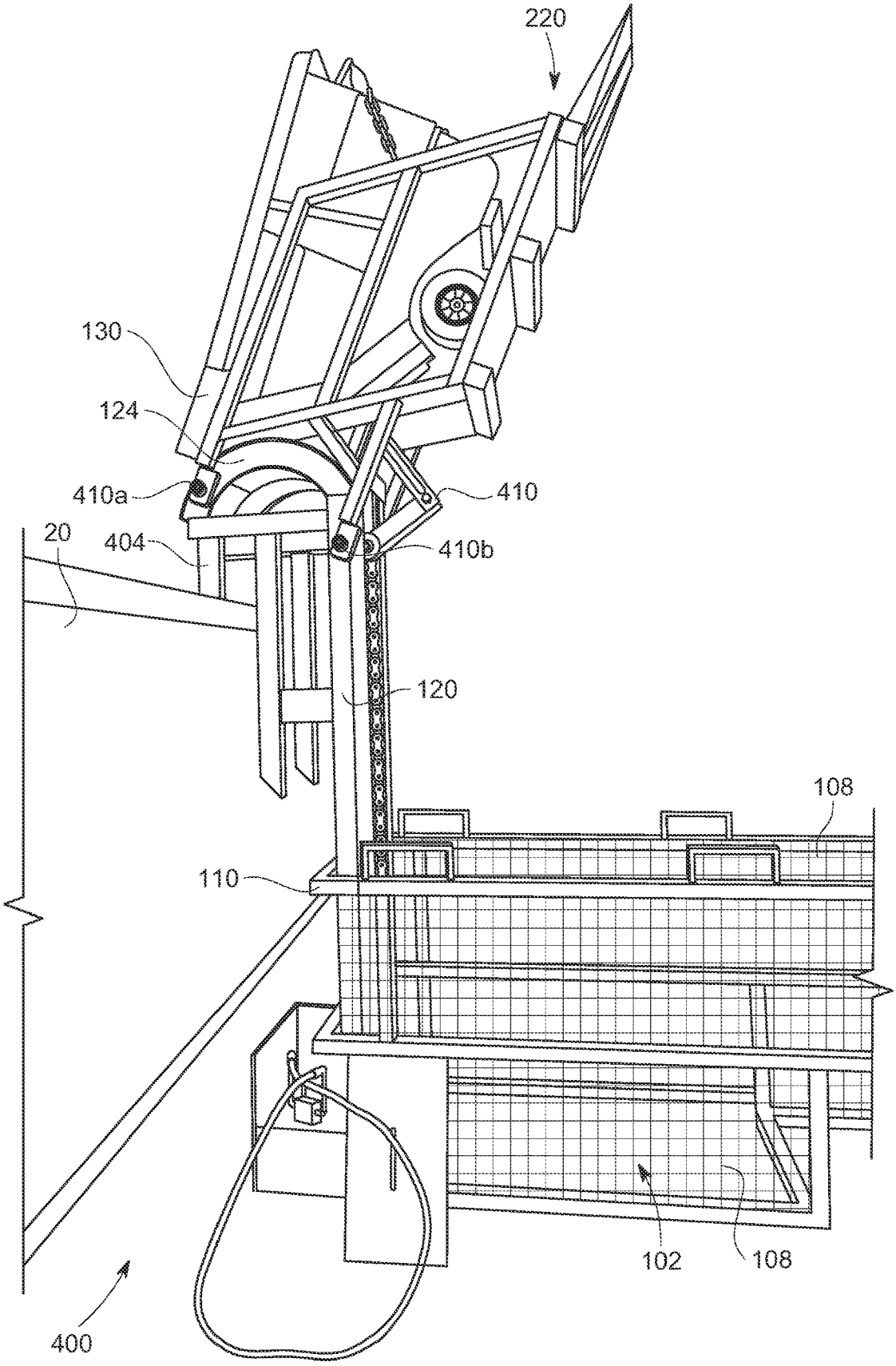
FIG. 9 illustrates a side perspective view of the apparatus of FIG. 8.
Figure 10:
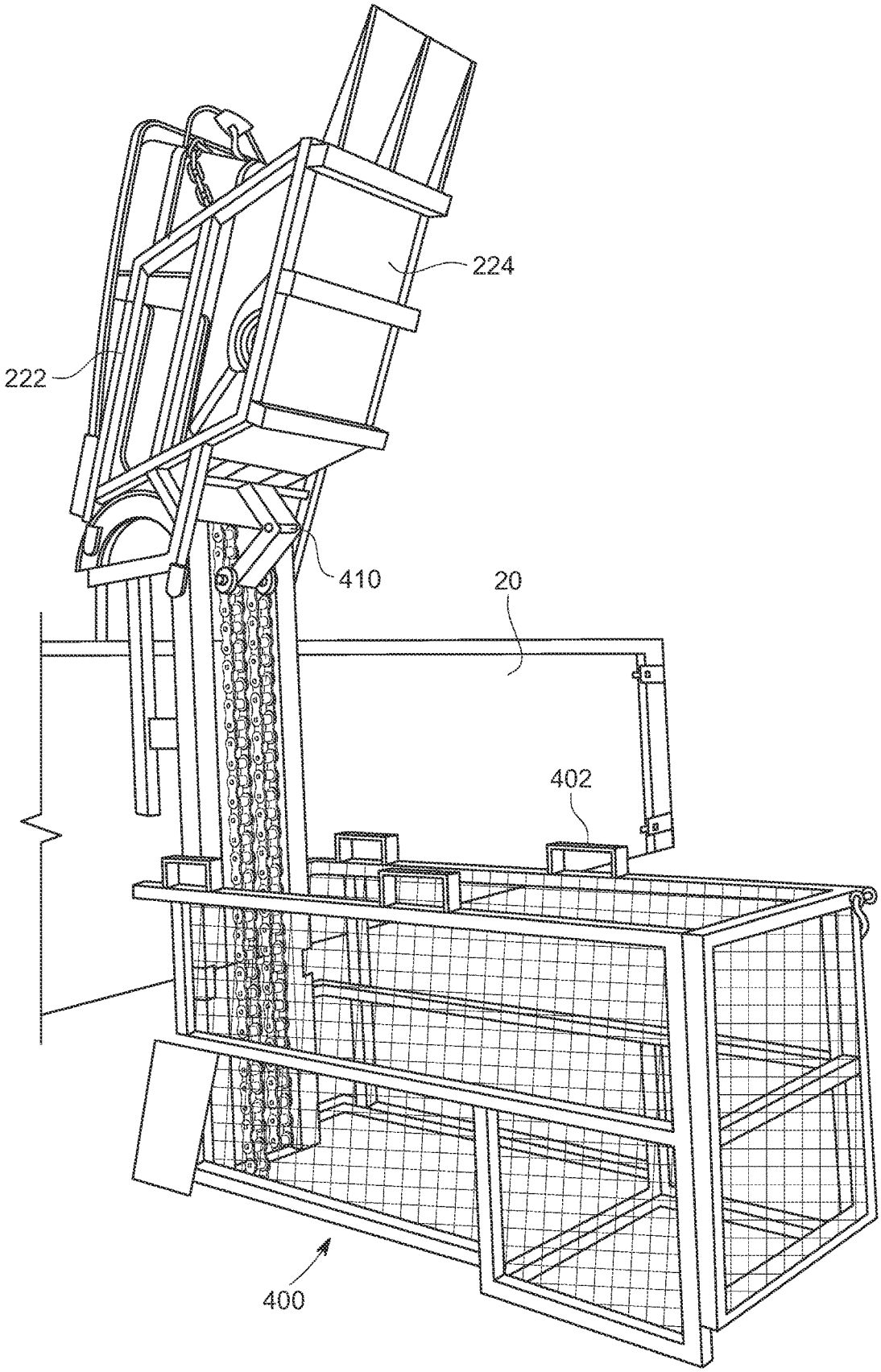
FIG. 10 illustrates a rear perspective view of the apparatus of FIG. 8.

FIGS. 8-10 illustrates an apparatus 400 according to yet another example and for use in moving refuse such as construction waste or the like into a waste container 20 such as a dumpster described above. Only elements that differ from those discussed above with respect to FIGS. 1-7 are described in detail for apparatus 400. Elements that are the same as or similar to those in FIGS. 1-7 are given the same reference number for simplicity.

The apparatus 400 has an outer frame 102 supported on a ground surface via a set of wheels 104. The wheels 104 are only shown for the apparatus 400 in FIG. 8, and are omitted from FIGS. 9-10. The frame has a pair of side walls 108 and a first end wall 110. The frame is provided without a floor member extending between the side walls and first end wall. The frame has a second end wall 403 that moves between an open position and a closed position.

A first and a second support member 120, 122 are connected to the frame 102. The first and second support members 120, 122 extend upwardly adjacent to the first end wall. Each of the first and second support members have a hooked region 124, 126 or transverse region to extend over an upper edge 22 of a waste container 20. As shown in the Figures, the hooked regions 124, 126 may be curved, or J-shaped or C-shaped. In one example, the hooked regions 124, 126 have a continuous radius of curvature.

The hooked regions 124, 126 may include alignment members 404, 406 that extend into the interior region of the waste container, and alongside an inner surface of the container wall. These alignment members 404, 406 are shown as being fixed or unadjustable in FIGS. 8-10; however, it is also envisioned that these alignment members 404, 406 are adjustable in length, e.g. via a telescoping structure or a hinge connection such that the alignment members 404, 406 may be deployed downwardly after the apparatus is positioned adjacent to the container, and retracted upwardly above the upper edge of the container side wall to move the apparatus 400 away from the container. The alignment members 404, 406 and/or the support members 120, 122 are provided with clamping assemblies 408 that are moveable to engage the side wall of the waste container when the apparatus 400 is in position and retain and attach the apparatus to the waste container. The clamping assemblies 408 may be mechanical clamping assemblies as shown, and in further examples, may be hydraulic or electric linear actuators. Alternatively, the clamping assemblies 408 may be magnetically actuated. The clamping assemblies as actuators may be controlled via the controller 160 and user interface 170. Multiple clamping assemblies 408 may be provided at various heights for use with containers having side walls with different heights or shapes. The alignment members 404, 406 and/or the support members 120, 122 may also be provided with bumpers opposite to the clamping assemblies 408 to cushion and retain the apparatus 400 relative to the container.

The apparatus 400 has a waste receptable lift assembly 220 with a subframe 222 connected to a floor 224. The subframe 222 also supports a first rail 130 and a second rail 132. The sub-frame may be provided with lifting brackets 402 for use with a forklift for moving the apparatus 400, e.g. onto a flatbed truck for transportation to a job site or facility, or for movement between different waste containers.

The subframe 222 is connected to the first and second support members 120, 122 for movement relative to and along the first and second support members. In one example, the subframe 222 has guides 410, such as rollers or the like, that are received within tracks formed in each of the support arms. Each guide of the subframe moves within and along the associated track of the support member. Guides 410*a* may be connected to the subframe adjacent to an upper edge region of the subframe, and guides 410*b* may also be connected to the subframe adjacent to the lower region of the subframe.

The lift assembly 220 is movable between a load position as shown in FIG. 8 and a dump position as shown in FIGS. 9-10.

Each of the rails 130, 132 receive a portion of the lip 34 of the waste receptacle 30 or gondola, and act as guides for the waste receptacle 30. The floor 224 may have an angled surface to prevent movement of the waste receptacle 30 towards the container 20. The subframe 222 may be provided with a crossbar or other cross member adjacent to the support members 120, 122 to prevent movement of the waste receptacle 30 towards the container 20.

The apparatus 300 has a dumping system 140. The dumping system 140 acts to move the lifting assembly 220 between the load position and the dump position. In the example shown, the dumping system 140 includes a drive system 240, such as a chain drive system, and a power system 260 that cooperate to move the lift assembly 220 relative to the first and second support members 120, 122 and the frame, and between a load position and a dump position. The chain drive system 240 has an upper and lower sprocket as described above, with the lower sprocket driven by a power system with a rotary output shaft. The chain drive system 240 has a chain extending from a first end to a second end. Each end of the chain is connected to a lifting bracket 410 such that the chain forms a continuous loop with the lifting bracket, and the chain is in meshed engagement with the upper and lower sprockets. The lifting bracket 410 is also connected to a lower region of the lift assembly 220. The lifting bracket 410 is shaped such that it continues to lift and exert a force on the lift assembly 220 as the lift assembly 220 rotates and follows the tracks on the hooked regions 124, 126 of the support arms 120, 122. The dumping system 140 may be provided, along with a controller 160 and a user interface 170, as described above with respect to FIGS. 1-7.

Figure 11:
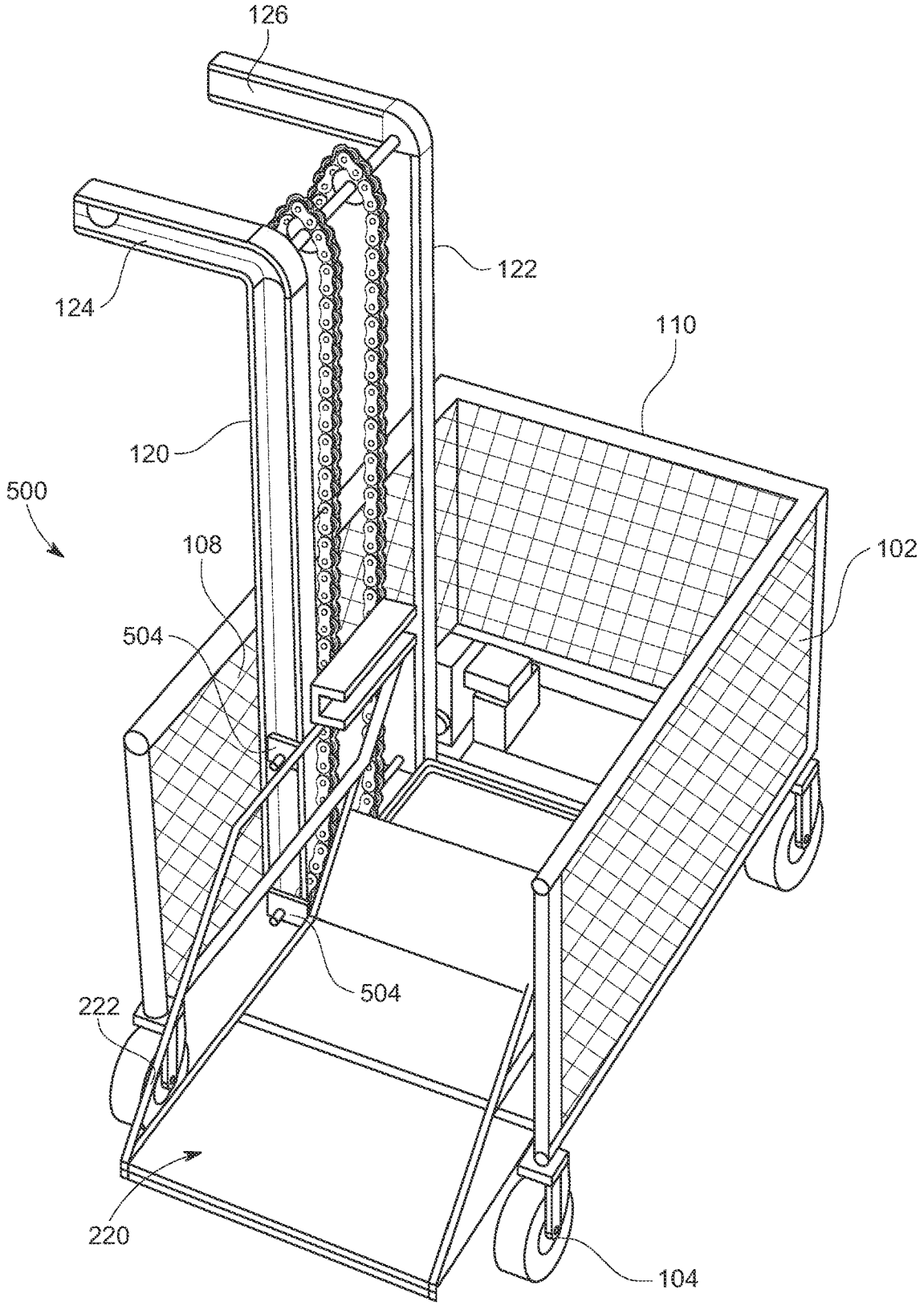
FIG. 11 illustrates a perspective view of an apparatus according to an embodiment and for use with a waste container and a portable waste receptacle.
Figure 12:
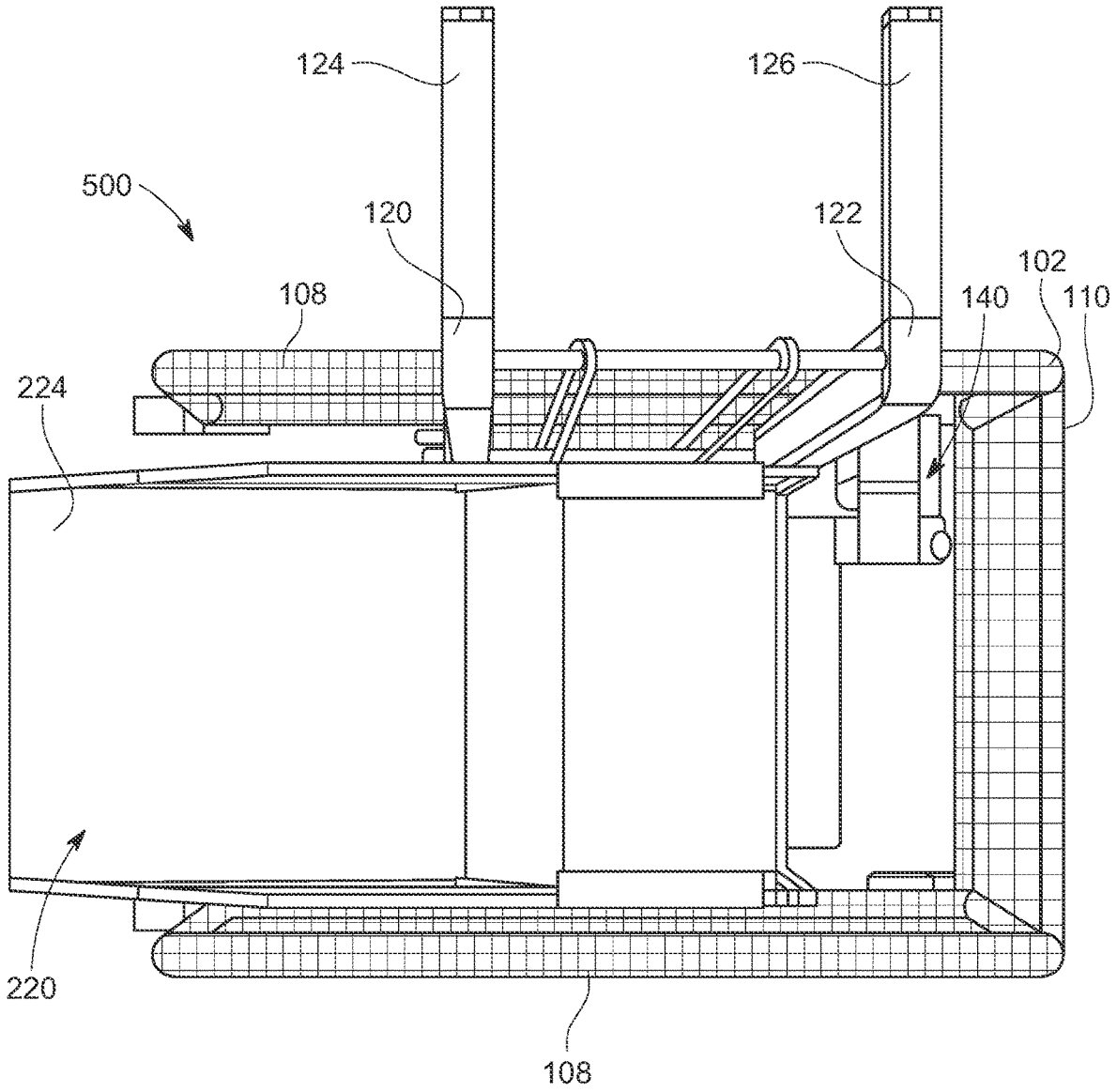
FIG. 12 illustrates a top view of the apparatus according to FIG. 11.
Figure 13:
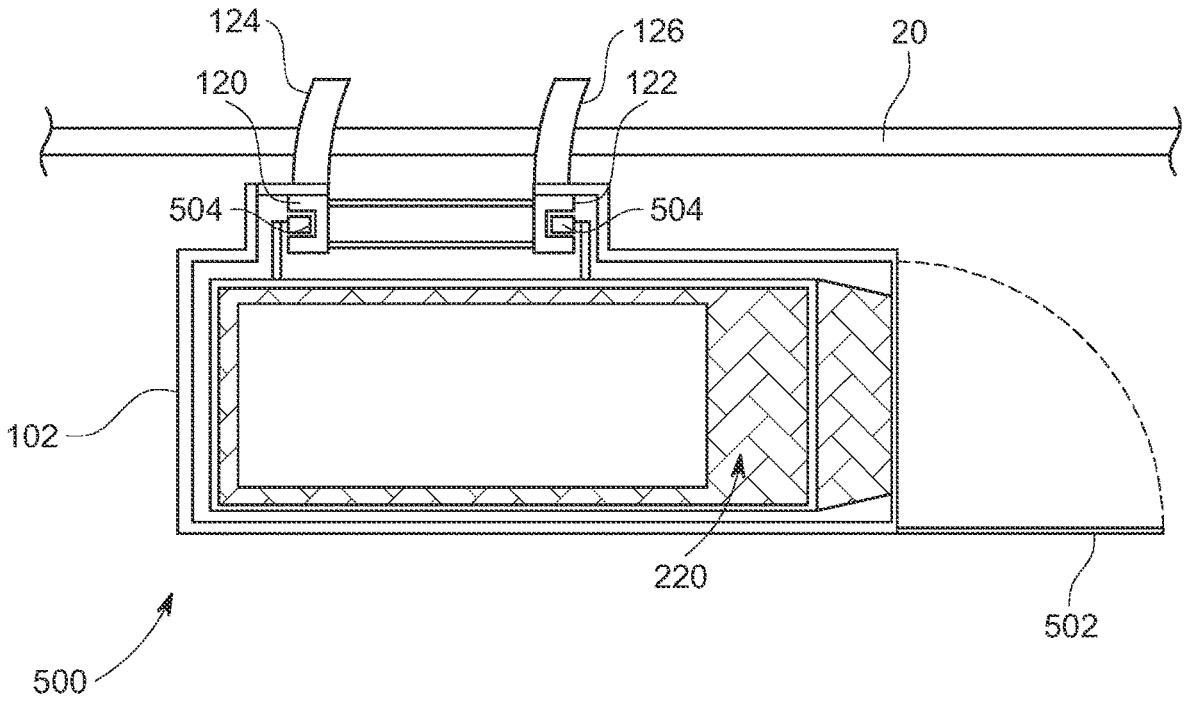
FIG. 13 illustrates a top schematic view of the apparatus of FIG. 11.

FIGS. 11-13 illustrates an apparatus 500 according to yet another example and for use in moving refuse such as construction waste or the like into a waste container 20 such as a dumpster described above. Only elements that differ from those discussed above with respect to FIGS. 1-10 are described in detail for apparatus 500. Elements that are the same as or similar to those in FIGS. 1-10 are given the same reference number for simplicity.

The apparatus 500 has an outer frame 102 supported on a ground surface via a set of wheels 104. The frame 102 has a pair of side walls 108 and a first end wall 110. The frame 102 is provided without a floor member extending between the side walls 108 and first end wall 110. The frame also has a second end wall 502 as shown in FIG. 13 that moves or swings between a closed position and an open position to access the interior region of the frame 102.

A first and a second support member 120, 122 are connected to the frame 102. The first and second support members 120, 122 extend upwardly adjacent to one of the side walls 108. Each of the first and second support members have a hooked region 124, 126 or transverse region to extend over an upper edge 22 of a waste container 20. Although the hooked regions 124, 126 are shown as linear, it is also envisioned that the hooked regions 124, 126 may be curved.

The apparatus 500 has a waste receptable lift assembly 220 with a subframe 222 connected to a floor 224. The subframe 222 also supports a first rail 130 and a second rail 132. The subframe 222 is connected to the first and second support members 120, 122 adjacent to the first rail 130 for movement relative to and along the first and second support members. In one example, the subframe 222 has guides 504, such as rollers or the like, that are received within tracks formed in each of the support arms 120, 122. Each guide 504 of the subframe moves within and along the associated track of the support member.

The lift assembly 220 is movable between a load position as shown in FIGS. 11-12 and a dump position. The apparatus 300 has a dumping system 140. Based on the geometry of the apparatus 500, the waste receptacle, or gondola, may be emptied by tipping it over sideways, or rotating it about its longitudinal axis. This geometry allows a waste receptacle to be rolled alongside and parallel to the adjacent sidewall of the waste container for loading into the apparatus 500, and further reduces the footprint needed for placement of the apparatus 500, and for clear space around the apparatus 500 for maneuvering of the waste receptacles. The apparatuses in FIGS. 1-10 in contrast provided for loading the waste receptacle in a direction perpendicular to the adjacent side wall of the container.

Figure 14:
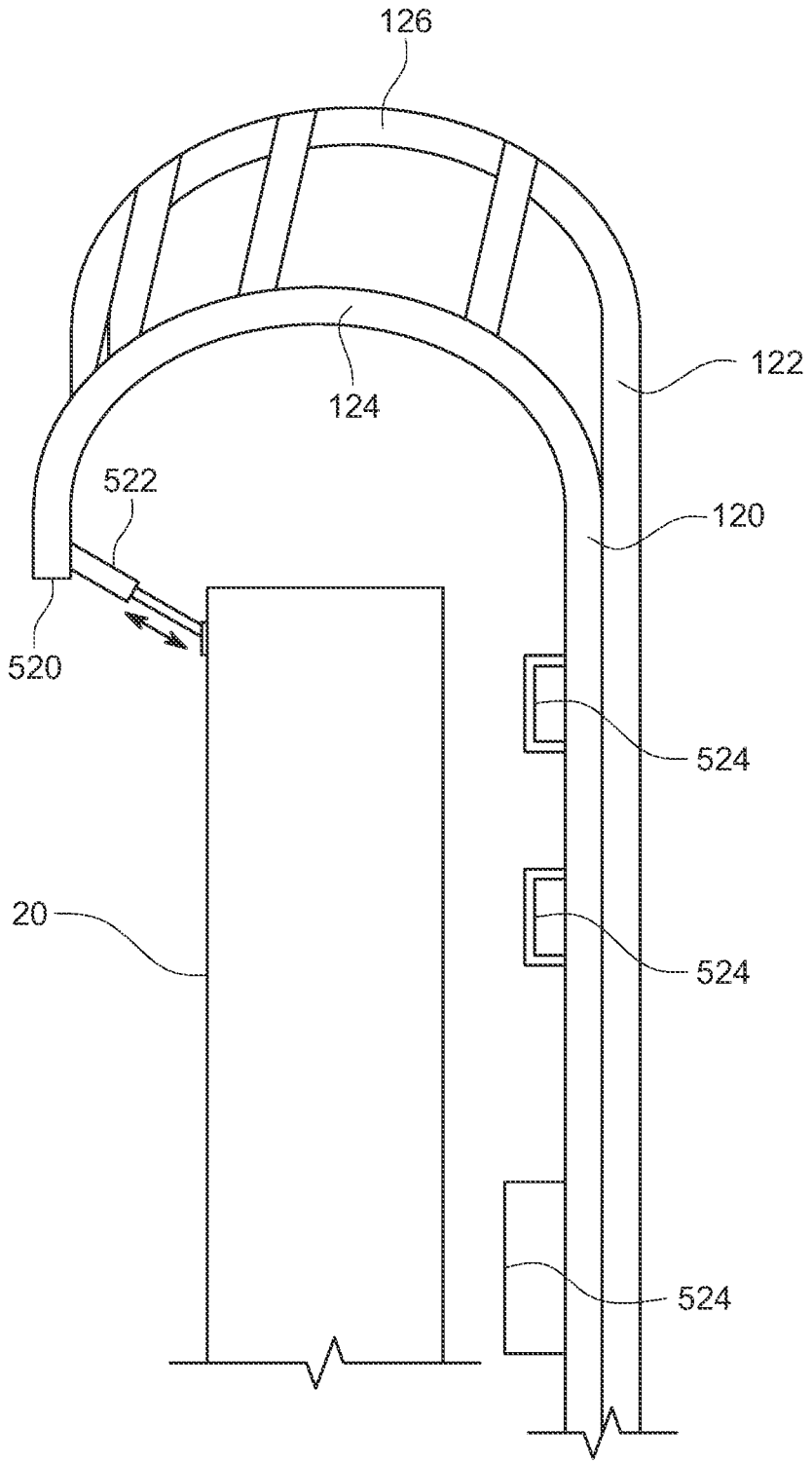
FIG. 14 illustrates a partial side schematic view of rails for use with the apparatus of FIG. 11.

FIG. 14 illustrates schematic views of the support members 120, 122 of FIG. 13 for use with the apparatus 500, or another apparatus 100, 200, 300, or 400 as described above. As shown in FIG. 14, support members 120, 122 extend vertically alongside the wall of the waste container. At the upper end of the support members 120, 122, a hooked region 124, 126 extends over the top of the wall of the waste container, and the hooked regions may be curved. The distal end 520 of the support members 120, 122 may be positioned to be above the upper end of the side wall of the container when the apparatus is in use.

Instead of alignment members and clamping assemblies as described above, the support members 120, 122 may be provided with an actuator 522, such as a hydraulic or electric linear actuators positioned on an end region of the hooked region 124, 126, with the actuators 522 angled downwardly, and at an acute angle relative to the vertical plane extending through the first and second support members 120, 122. Although only one actuator 522 is shown, the apparatus may be provided with two or more actuators, with an actuator on an end region of each of the support members 120, 122. The actuators 522 are extendible to engage an inner surface of the side wall of the container as shown in FIG. 41 and retain and attach the apparatus to the container. The support members 120, 122 may be provided with stand-off elements and/or bumpers that also engage the container wall when the actuator 522 is fully extended. The actuators 522 may be controlled via the controller 160 and user interface 170. The actuators 522 and the bumpers 524 limit or prevent movement of the apparatus along an axis perpendicular to the associated side wall of the container.

In further examples, one or more of the wheels 104 of the apparatus 100, 200, 300, 400, 500 may be provided as a drivable wheel, e.g. via an electric motor powered by a battery. Alternatively, one or more of the wheels may be provided with a hydraulic actuator that is in fluid communication with the pump of a hydraulic system on-board the apparatus, and the hydraulic actuator may be configured to drive the wheel. A drivable wheel allows for the apparatus to be more easily moved and positioned by a user relative to the waste container 20, and also aids in moving the apparatus further distances.

In another example, the apparatus 100, 200, 300, 400, 500 may be provided with one or more steps or a ladder that is connected to a side of the frame. If steps are provided, the steps may fold relative to the frame for storage. The steps or ladder allow for a user to visually examine the inside of a waste container 20 to inspect the interior of the waste container 20 and to determine the amount of waste and its location within the container 20. By using steps or a ladder, the apparatus may be better positioned by a user to empty a waste receptacle 30 into a region of the waste container 20 with a lower level of waste. Alternatively, a camera may be positioned on the hooked region of one of the support members, and provide a signal to a display interface of the user interface for viewing by a user.

The apparatus 100, 200, 300, 400, 500 may be provided with one or more sets of inserts for use with waste receptacles 30 of different sizes and/or shapes. In one example, each insert is received by the associated rails 130, 132 and is connected to the rails via a removable fastener or the like such that the inserts may be changed or removed entirety. Each insert has an outer face that cooperates with the rails, and an inner face that provides another rail sized to receive a waste receptacle 30. In one example, an insert allows for use of the apparatus with a tilt truck or gondola having a width that is too narrow for use with the apparatus without the insert. In another example, an insert is provided that allows a cylindrical waste receptacle 30, such as a drum, to be received and retained by the insert and listed by the apparatus. The insert for the cylindrical waste receptacle 30 may include a strap with a ratchet mechanism, or the like to conform to the shape of the waste receptacle 30 and secure it.

Alternatively, the associated rails 130, 132 of the apparatus 100, 200, 300, 400, 500 may be adjustable in width or spacing for use with waste receptacles 30 of different sizes. For example, the rails 130, 132 may be supported on the frame 102 for translational movement relative to the frame and relative to one another via a lead screw system, a scissor mechanism, or the like. The rails may be adjustable both in height as well as in width, or distance apart from one another.

In various examples, the frame 102 of the apparatus 100, 200, 300, 400, 500 may be provided with slots or similar features to allow the entire apparatus to be easily lifted by a forklift for transportation. An example of brackets 402 for use with a forklift is shown in FIGS. 8-10 with apparatus 400.

While exemplary embodiments are described above, it is not intended that these embodiments describe all possible forms of the disclosure and invention. Rather, the words used in the specification are words of description rather than limitation, and it is understood that various changes may be made without departing from the spirit and scope of the disclosure. Additionally, the features of various implementing embodiments may be combined to form further embodiments of the invention.

What is claimed is:

1. An apparatus comprising:

an outer frame having an end wall positioned between and connecting first and second side walls, the outer frame having a series of wheels to support the outer frame on an underlying ground surface;

a first support arm and a second support arm, each support arm connected to the outer frame and extending upwardly from the outer frame to a hooked region, each hooked region extending outwardly from the associated support arm and away from the outer frame to extend over an upper edge of an adjacent waste container;

a lifting assembly positioned within the outer frame, the lifting assembly having a subframe with a floor, the subframe supporting first and second rails, wherein at least one of the first and second rails is supported by the first and second support arms for translation relative thereto such that the lifting assembly is moveable relative to the first and second support arms between a load position and a dumping position, wherein each of the first and second rails have an upper flange and a lower flange sized to slidably receive an upper lip of a portable waste receptacle therebetween;

a chain drive system having an upper sprocket and a lower sprocket supported by the first support arm, and a chain in meshed engagement with the upper and lower sprockets, the chain connected to the lifting assembly such that the chain drive system is operable to move the lifting assembly relative to the first support arm;

a rotary motor with a rotary output shaft drivingly connected to the lower sprocket, the rotary output shaft rotating about a longitudinal axis extending though the rotary output shaft; and a controller in communication with the motor to control a position of the lifting assembly relative to the chain drive system.

2. The apparatus of claim 1 further comprising an alignment member affixed to a distal end of the hooked region such that the lifting assembly moves relative to the alignment member, the alignment member sized and positioned to extend into an interior of the waste container and limit movement of the apparatus relative to an adjacent side wall of the adjacent waste container.

3. The apparatus of claim 1 further comprising a clamping assembly affixed to the first support arm, the clamping assembly positioned to engage a side wall of the adjacent waste container in a deployed position and limit movement of the apparatus relative thereto, wherein the clamping assembly is configured to be in the deployed position when the lifting assembly moves from the load position to the dumping position.

4. An apparatus comprising:

an outer frame having an end wall positioned between and connecting first and second side walls, the outer frame having a series of wheels to support the outer frame on an underlying ground surface;

at least one support arm connected to the outer frame and extending upwardly from the outer frame to a hooked region, the hooked region shaped to extend over an upper edge of a waste container;

at least one rail positioned adjacent and alongside the outer frame, the at least one rail supported by the at least one support arm for translation relative thereto, wherein the at least one rail has an upper flange and a lower flange that each extend longitudinally along the rail and are fixed relative to one another, the upper flange and the lower flange being spaced apart from one another and sized to slidably receive an upper lip of a portable waste receptacle therebetween, the upper and lower flanges each configured to cooperate with the upper lip of the portable waste receptacle to limit movement of the portable waste receptacle in a direction transverse to the upper and lower flanges;

a dumping system having a lifting assembly driven by a power assembly, the dumping system connected to the outer frame and the at least one rail to move the rail along the at least one support arm between a load position and a dumping position;

an alignment member affixed to a distal end of the hooked region;

a clamping assembly affixed to one of the at least one support arm and the alignment member, the clamping assembly positioned to engage a side wall of the waste container in a deployed position and limit movement of the apparatus relative thereto, wherein the clamping assembly is configured to be in the deployed position as the lifting assembly moves from the load position to the dumping position; and a controller in communication with the dumping system to control a position of the first and second rails via the dumping system.

5. The apparatus of claim 4 wherein the lifting assembly is provided by a chain drive system having an upper sprocket supported by the at least one support arm, and a lower sprocket supported by the at least one support arm.

6. The apparatus of claim 5 wherein the lower sprocket is driven by the power assembly.

7. The apparatus of claim 6 wherein the power assembly comprises a rotary motor with a rotary output shaft drivingly connected to the lower sprocket, the rotary output shaft rotating about a longitudinal axis extending though the rotary output shaft.

8. The apparatus of claim 4 wherein the at least one support arm is provided by first and second support arms, and wherein the at least one rail is provided by a first rail supported by the first support arm for movement relative thereto, and a second rail supported by the second support arm for movement relative thereto.

9. The apparatus of claim 8 wherein the first and second support arms are directly adjacent to the first side wall and the first rail.

10. The apparatus of claim 8 wherein the first and second support arms are directly adjacent to the end wall, and wherein the first and second support arms are positioned between the first and second rails.

11. The apparatus of claim 4 wherein the lifting assembly is provided by a hydraulic system having a first hydraulic strut extending between the at least one rail and the outer frame.

12. The apparatus of claim 4 further comprising a motor drivingly connected to at least one wheel of the series of wheels to propel the apparatus over the underlying ground surface.

13. The apparatus of claim 4 wherein the end wall is a first end wall; and wherein the outer frame has a floor extending between the first and second side walls and the end wall; and wherein the outer frame has a second end wall opposite to the first end wall that is moveable relative to the floor between a first position in contact with the underlying ground surface and a second position.

14. The apparatus of claim 4 wherein the at least one rail is provided with a guide at a distal end thereof, the guide received within a track of the support arm such that the guide moves within the track and follows the support arm as the dumping system is operated.

15. The apparatus of claim 4 wherein the lifting assembly has a subframe with a floor extending transversely across the subframe to support the portable waste receptacle, the subframe supporting the at least one rail above the floor in the load position, wherein the lifting assembly is moved by the dumping system relative to the at least one support arm.

16. The apparatus of claim 4 further comprising a user interface in communication with the controller, the user interface providing a control panel, an alert system, and/or a display.

17. The apparatus of claim 4 wherein the hooked region extends outwardly from an upper end of the at least one support arm and away from the outer frame, wherein the rail is further supported by the hooked region for translation relative to the hooked region.

18. The apparatus of claim 17 wherein the lifting assembly and at least one rail move relative to the alignment member, and wherein the alignment member is sized and positioned to extend into an interior of the waste container and limit movement of the apparatus relative to the waste container.

19. The apparatus of claim 17 further comprising an actuator affixed to a distal end of the hooked region, the actuator moveable to a deployed position to engage a side wall of the waste container and limit movement of the apparatus relative thereto, wherein the actuator is configured to be in the deployed position as the lifting assembly moves from the load position to the dumping position.

* * * * *